US012612858B2

(12) United States Patent
Mølstre

(10) Patent No.: US 12,612,858 B2
(45) Date of Patent: Apr. 28, 2026

(54) CONTROLLED TRACER RELEASE SYSTEM AND METHOD OF USE

(71) Applicant: RESMAN AS, Ranheim (NO)

(72) Inventor: Øystein Mølstre, Ranheim (NO)

(73) Assignee: Resman Technology AS, Ranheim (NO)

( * ) Notice: Subject to any disclaimer, the term of this patent is extended or adjusted under 35 U.S.C. 154(b) by 0 days.

(21) Appl. No.: 18/715,192

(22) PCT Filed: Dec. 9, 2022

(86) PCT No.: PCT/EP2022/085224
§ 371 (c)(1),
(2) Date: May 31, 2024

(87) PCT Pub. No.: WO2023/105063
PCT Pub. Date: Jun. 15, 2023

(65) Prior Publication Data

US 2025/0146404 A1 May 8, 2025

(30) Foreign Application Priority Data

Dec. 10, 2021 (GB) ..... 2117921

(51) Int. Cl.
*E21B 47/11* (2012.01)

(52) U.S. Cl.
CPC ..... *E21B 47/11* (2020.05)

(58) Field of Classification Search
CPC ..... E21B 47/11
See application file for complete search history.

(56) References Cited

U.S. PATENT DOCUMENTS

2003/0056952 A1 3/2003 Stegemeier et al.

FOREIGN PATENT DOCUMENTS

| | | | | |
|---|---|---|---|---|
| GB | 1405316 A | | 9/1974 | |
| GB | 2569868 A | | 7/2019 | |
| WO | WO 200165053 A1 | | 9/2001 | |
| WO | WO 2017131530 A1 | | 8/2017 | |
| WO | WO 2020239647 A2 | | 12/2020 | |
| WO | WO-2020239648 A2 | * | 12/2020 | ..... E21B 43/38 |
| WO | WO 2020239649 A2 | | 12/2020 | |

OTHER PUBLICATIONS

International Search Report and Written Opinion dated Mar. 14, 2023 for PCT/EP2022/085224.

* cited by examiner

*Primary Examiner* — Crystal J Lee
(74) *Attorney, Agent, or Firm* — FisherBroyles, LLP

(57) ABSTRACT

The invention provides a tracer release system for releasing tracer into a well. The tracer release system comprises at least one tracer release apparatus. The apparatus comprises at least one tracer source reservoir comprising at least one tracer, at least one injection port configured to be in fluid communication with the well; and at least one controllable valve located between the at least one tracer source reservoir and the at least one injection port. The at least one controllable valve is configured to control an even release of the at least one tracer into the well for a desired duration and/or frequency.

23 Claims, 10 Drawing Sheets

CONTROLLED TRACER RELEASE SYSTEM AND METHOD OF USE

This application is the U.S. National Stage of International Application No. PCT/EP2022/085224, which was filed on Dec. 9, 2022. This application also claims the benefit of the filing date of GB patent application No. GB2117921.3, which was filed on Dec. 10, 2021. The contents of both of those applications are hereby incorporated by reference.

The present invention relates to apparatus and method for well monitoring using tracers. Aspects of the invention include an apparatus to control and monitor the release of tracer material into a well to allow measurement and monitoring of characteristics of flow in a producing or inter well system.

BACKGROUND TO THE INVENTION

Downhole tracers released into the production flow in a producing well has been previously used for estimating which fluids flow in parts of the well.

Methods of monitoring fluid rate based on transient flow where distinct tracers are arranged at different influx zones in a well are known. EP2633152 discloses a method of estimating influx profile for well fluids to petroleum well. The method comprises inducing a transient in the production rate of the entire production flow by shutting in the well. The well is shut-in for a period of time to allow a high concentration of tracers to build up in the well and then the well is re-started to carry the tracers to surface. Sampling and analysis of the concentration of the different tracers is used to provide qualitative and quantitative production data.

However, these methods limit the number of opportunities for obtaining tracer data, as shutting in the well is a complex and highly expensive operation requiring significant project planning and resulting in loss of revenue due to interruption to production.

Regularly restarting a well after a shut in may present risks to the well infrastructure. Forcing the fluid column in the well to start moving after a long period of rest may lead to very complex pressure, flow rate and temperature changes in the infrastructure. The sudden changes can pose a real threat to equipment, in the worst case, permanently impairing production or even requiring recompleting or sidetracking the well.

It may also be problematic lifting a column of heavy fluids when restarting a well after a shut in. In some cases restarting a well may not be possible.

The above systems require the capture of tracer data released during or shortly after well restart. High frequency sampling must be regularly taken to ensure that the transient tracer data is captured. If samples are not taken at sufficient frequency or over a long enough period, aspects of the tracer data may be lost.

Tracer injection systems for downhole use are described in U.S. Pat. No. 6,840,316 B2 and WO2016137328A1. Tracer is typically injected into the main flow path of the well. However, a problem of known tracer injection techniques is that there are limitations on the amount of tracer that may be located downhole and the battery life of the tracer injector system. It is also difficult to accurately control the release of tracers at different sections of the well and stringent sampling must be taken at surface otherwise essential data may be missed and may present uncertainties in the flow analysis preformed topside.

SUMMARY OF THE INVENTION

It is amongst the aims and objects of the invention to provide a method and system for monitoring downhole zonal contributions of well fluid to production flow in a petroleum production well.

It is another object of the present invention to provide a tracer release system for selectively controlling the release and duration of tracer release into the well to allow accurate production flow measurement and wellbore inflow profiles to be calculated and monitored.

It is a further object of an aspect of the invention to provide a method and system for estimating the distribution of inflow rates in hydrocarbon wells without requiring the well to be shut in.

It is another object of the present invention to provide a tracer release system which is capable of controlling the volume and/or rate of high concentration of tracer released as a tracer cloud to extend the lifespan of the tracer downhole.

Further aims and objects of the invention will become apparent from reading the following description.

SUMMARY OF THE INVENTION

According to a first aspect of the invention, there is provided a tracer release system for releasing tracer into a well; the tracer release system comprising;

- at least one tracer release apparatus comprising;
- at least one tracer source reservoir comprising at least one tracer;
- at least one injection port configured to be in fluid communication with the well; and
- at least one controllable valve located between the at least one tracer source reservoir and the at least one injection port;
- wherein the at least one controllable valve is configured to control an even release of the at least one tracer into the well for a desired duration and/or frequency.

The tracer release system may comprise at least one control unit configured to control the actuation of the at least one controllable valve to control and/or adjust the even release of tracer into the well for a desired duration and/or frequency. The at least one control unit may be configured to actuate the at least one controllable valve to release tracer at an even release rate for a preset duration and/or frequency into the well. Providing a tracer release system with a controllable even release of tracer into the well may facilitate a continuously release of tracer at the same rate for a sustained period of time. This may allow continuous monitoring of the well.

The at least one injection port may be in fluid communication with a production pipe or an annulus. The annulus may be located between a production pipe and a borehole wall.

The at least one control unit may be configured to adjust and/or control the duration and/or frequency of the actuation of the at least one valve. The at least one control unit may be configured to actuate the at least one controllable valve to allow continuous release of tracer. The at least one control unit may be configured to actuate the at least one controllable valve to control the release of tracer from the at least one tracer source reservoir through the at least one injection port out into the well.

The at least one controllable valve may be configured to release tracer at an even release rate while the at least one controllable valve is in an open and/or release condition. The at least one control unit and/or the at least one controllable valve may be configured to release tracer at an even release rate and/or continuous release rate throughout a period of time the at least one controllable valve is in an open and/or release condition.

The at least one control unit and/or the at least one controllable valve may be configured to release tracer at a set release rate throughout the period of time that the at least one controllable valve is in the open and/or release condition. The at least one control unit may be a component of the at least one tracer release apparatus. The at least one control unit may be located downhole.

The at least one control unit may be configured to actuate the at least one controllable valve to release tracer at a controlled release rate into the well. The at least one controllable valve may be configured to continuously release of tracer at the same rate. The at least one tracer release apparatus may be configured to adjust the continuous release rate of tracer. The tracer release apparatus may be configured to release a continuous high concentration of tracer which can be detected in the well fluid at a position downstream of the tracer release apparatus and/or at surface.

The at least one control unit may be pre-programmed. The at least one control unit may be configured to actuate the at least one valve in response to a timer and/or a signal from surface. The at least one control unit may be configured to actuate the at least one controllable valve in response to a pre-set programme and/or timer. The at least one control unit may be configured to actuate the at least one controllable valve in response to a command signal from surface. The at least one control unit may be configured to actuate the at least one controllable valve in response to a trigger event.

The tracer release system may comprise an elongated mandrel main body. The tracer release system may be configured to be installed and/or arranged parallel to a production pipe in the well or in an annulus. The at least one valve may be an electromagnetic valve and/or an electronically controlled valve. The at least one valve may be a throttle valve or a flap valve. The well may be an injector well or a production well.

The tracer release system may be controlled to selectively release tracer into a well, a reservoir and/or a production flow to allow flow measurement and/or wellbore inflow profiles to be calculated and monitored.

The tracer release apparatus may be configured to release at least one tracer. The at least one tracer may be a liquid, solid or gas. The at least one tracer may be a powdered solid. The tracer release apparatus may be configured to build up a high or increased concentration of tracer and selectively releasing the tracer without requiring the well to be shut in.

The tracer release apparatus may be configured to release a high concentration of tracer as a tracer cloud which can be detected in at least one well fluid downstream of the tracer release system and/or at surface. This may allow control of the exposure of the tracer source to production fluid to extend the lifespan of the tracer downhole.

The at least one valve may be configured to selectively open and close between a fully open position, a fully closed position, or to an intermediate position between the fully open and fully closed position. The at least one valve may be operated to control flow and vary the area of openings for flow through the at least one injector port. The at least one valve may be adjustably set to be normally open or normally closed. The at least one valve may comprise a biasing mechanism. The at least one valve may be balanced or biased by a biasing mechanism. The biasing mechanism may be a spring. The biasing mechanism may be a coil spring, a wave spring or a gas spring such as a nitrogen gas spring.

The tracer release system may be configured to control the volume of tracer released. The at least one valve and/or the at least one control unit may be configured to control and/or adjust the volume of tracer released. The at least one valve and/or the at least one control unit may be configured to control and/or adjust the volume of tracer released when the valve is opened.

The volume, duration, release rate and/or frequency of the tracer release may be adjustably set. The volume, duration and/or frequency of the tracer release may be adjusted or configured depending on the desired operation or lifespan of the tracer release system. For example, a tracer release system designed for a long downhole lifespan may require a smaller fluid volume release to restrict the amount of tracer released with each release operation. Similarly the duration and/or the frequency may be controlled and/or adjusted on command.

The system may be controlled and/or programmed to release tracer periodically for example hourly, weekly or monthly. The period may be adjustably controlled and set. The system may be controlled and/or programmed to release tracer manually or automatically. The system may be controlled and/or programmed to release tracer on command and/or in response to a trigger event.

The at least one control unit may be configured to release tracer on command. The at least one controllable valve may be configured to release tracer from the at least one tracer release apparatus in the form of a pulse. The at least one control unit may be configured to release tracer from the one or more tracer release apparatus in the form of a pulse. The at least one control unit may be configured to control the duration of the tracer release pulse. By duration it is meant the time period that the tracer is released from the tracer apparatus when actuated by the at least one control unit. The at least one control unit may be configured to control the interval between each tracer release which is also known as the frequency of tracer release pulse. The at least one control unit may be configured to control the duration and/or frequency of the tracer release pulse.

The tracer release pulse duration range may be between 0.01 seconds and 10 days. The pulse interval or pulse frequency may be in the range of 0.1 seconds to one year. The well may be an injection well or a production well. The duration and/or frequency of the tracer release pulse may be dependent on the application of the tracer release in an injection well or production well.

In a production well the at least one control unit may be configured to have a tracer release pulse duration in the range of 0.01 seconds to 1 day. The tracer release pulse duration range may be between 0.05 seconds and 5 hours. Preferably the tracer release pulse duration range is between 0.1 seconds and 10 minutes. In a production well the control unit may be configured to have a programmed pulse interval or pulse frequency in the range of 10 minutes to several months. Preferably the programmed pulse interval or pulse frequency in the range of 12 hours to 10 days. The tracer release system may be configured to be arranged in a production well, wherein the desired duration of tracer release is in the range of 0.1 seconds and 10 minutes, and the desired frequency of tracer release is in the range of 12 hours to 10 days.

In an injection well the at least one control unit may be configured to have a tracer release pulse duration in the range of 30 minutes to 10 days. Preferably the tracer release pulse duration range is between 2 hours and 3 days. In an injection well the at least one control unit may be configured to release tracer on command. The control unit may have a programmed pulse interval or pulse frequency in the range of one month to one year. The release system may be configured to be arranged in an injection well, wherein the desired duration is in the range of 2 hours to 3 days and/or the desired frequency is in the range of 1 month to 1 year.

If there are two or more tracer release apparatus then the at least one control unit may be programmed to control the release of tracer from each apparatus independently from one another or in synchrony with one another. The at least one control unit may control the actuation of the two or more tracer release apparatus such that the tracer releases overlap.

The at least one control unit may be configured to actuate the release of tracer from a first tracer release apparatus multiple times within the same time frame that a second or further tracer release apparatus is actuated once to release tracer. The at least one control unit may be configured to adjust the duration of the tracer release. The at least one control unit may be configured to adjust the pulse interval or pulse frequency of the tracer release. The at least one control unit may be configured to allow manual control of the duration of the tracer release from an operator at surface.

Each tracer source reservoir may comprise at least one tracer, The at least one tracer may be selected from the group comprising chemical, fluorescent, phosphorescent, DNA and radioactive compounds. The at least one tracer may comprise chemical tracers selected from the group comprising perfluorinated hydrocarbons or perfluoroethers. The perfluorinated hydrocarbons may be selected from the group of perfluoro butane (PB), perfluoro methyl cyclopentane (PMCP), perfluoro methyl cyclohexane (PMCH).

The tracer release system may comprise at least one pump or at least one accumulator. The at least one pump or at least one accumulator may be configured to pressurise the at least one tracer in the at least one tracer source reservoir. The at least one pump or at least one accumulator may be configured to pressurise the at least one tracer before it is injected and/or released at an even rate of release into the well. By pressurising the at least one tracer in the at least one tracer source reservoir the tracer may be released from the at least one tracer release apparatus at a substantial continuous rate and/or even release rate irrespectively of the amount of tracer remaining in the tracer source reservoir. The at least one pump or at least one accumulator may be adjustably set to change the pressure of the tracer in the least one tracer source reservoir. The pump or at least one accumulator may be configured to maintain a positive pressure acting on the at least one tracer in the at least one tracer source reservoir to maintain an even release rate of tracer during a period of time the tracer apparatus is in a tracer release condition According to a second aspect of the invention, there is provided a tracer release system for releasing tracer into a production well;

the tracer release system comprising;

at least one tracer release apparatus comprising;

at least one tracer source reservoir comprising at least one tracer;

at least one injection port configured to be in fluid communication with the well;

at least one controllable valve between the at least one tracer source reservoir and the at least one injection port;

wherein the at least one controllable valve is configured to control an even release of the at least one tracer into the well for a desired duration and/or frequency.

The at least one controllable valve may be configured to release tracer continuously into the well for an adjustably set duration and/or frequency. The tracer release system may comprise at least one control unit. The at least one control unit configured to actuate the at least one controllable valve to release tracer continuously into the well for an adjustably set duration and/or frequency. The control unit and/or the controllable valve may be configured to release tracer at an even release rate while the at least one controllable valve is in the open and/or release condition. The tracer release system may comprise at least one power source.

The at least one tracer release apparatus may be configured to be placed, arranged, installed and/or positioned at at least one known location of a well. The tracer release system may comprise two or more tracer release apparatus. Each of the two or more tracer release apparatus may be configured to be placed, arranged, installed and/or positioned at a known location of a well. Each of the two or more tracer release apparatus may be configured to be placed, arranged, installed and/or positioned at the same or different known locations of a well. The at least one tracer release apparatus may be configured to be placed, arranged, installed and/or positioned downstream and/or in the vicinity of at least one influx zone in a well. Each of the two or more tracer release apparatus may be configured to be placed, arranged, installed and/or positioned downstream and/or in the vicinity of at least one influx zone in a well.

Embodiments of the second aspect of the invention may include one or more features of the first aspect of the invention or its embodiments, or vice versa.

According to a third aspect of the invention, there is provided a tracer release system for releasing tracer into an injection well;

the tracer release system comprising;

at least one tracer release apparatus comprising;

at least one tracer source reservoir comprising at least one tracer;

least one injection port configured to be in fluid communication with the well;

at least one controllable valve between the at least one tracer source reservoir and the at least one injection port;

wherein the at least one controllable valve is configured to control an even release of the at least one tracer into the well for a desired duration and/or frequency.

The at least one controllable valve may be configured to release tracer continuously into the well for an adjustably set duration and/or frequency. The tracer release system may comprise at least one control unit. The at least one control unit configured to actuate the at least one controllable valve to release tracer continuously into the well for an adjustably set duration and/or frequency. The system may be configured to releasing tracer into an injector well and/or a producer well of an injection well.

The control unit and/or the controllable valve may be configured to release tracer at an even release rate while the at least one controllable valve is in the open and/or release condition. The tracer release system may comprise at least one power source.

The at least one tracer release apparatus may be configured to be placed, arranged, installed and/or positioned at at least one known location of a well. The tracer release system may comprise two or more tracer release apparatus. Each of the two or more tracer release apparatus may be configured to be placed, arranged, installed and/or positioned at a known location of a well. Each of the two or more tracer release apparatus may be configured to be placed, arranged, installed and/or positioned at the same or different known locations of a well. The at least one tracer release apparatus may be configured to be placed, arranged, installed and/or positioned upstream and/or in the vicinity of at least one injection zone in a well.

Embodiments of the third aspect of the invention may include one or more features of the first or second aspects of the invention or their embodiments, or vice versa.

According to a fourth aspect of the invention, there is provided a tracer release apparatus comprising;

at least one tracer source reservoir comprising at least one tracer;

at least one injection port configured to be in fluid communication with the well;

at least one controllable valve between the at least one tracer source reservoir and the at least one injection port;

wherein the at least one controllable valve is configured to control an even release of the at least one tracer into the well for a desired duration and/or frequency.

The tracer release apparatus may comprise at least one control unit configured to actuate the at least one controllable valve to control the even release of tracer into the well for a preset duration and/or frequency. The tracer release apparatus may comprise at least one power source.

Embodiments of the fourth aspect of the invention may include one or more features of any of the first to third aspects of the invention or their embodiments, or vice versa.

According to a fifth aspect of the invention, there is provided a method of monitoring flow in a well and/or a reservoir in fluid communication with a well comprising;

providing a tracer release system for releasing at least one tracer into a well;

the tracer release system comprising;

at least one tracer release apparatus comprising;

at least one tracer source reservoir comprising at least one tracer;

at least one injection port in fluid communication with the well;

at least one controllable valve between the tracer source reservoir and the at least one injection port;

actuating the at least one controllable valve to release the at least one tracer at an even release rate for a preset duration and/or frequency into the well.

The method may comprise controlling the at least one controllable valve to adjust the duration and/or frequency of the release of the at least one tracer. The method may comprise releasing at least one tracer at at least one known position in the well. The method may comprise releasing at least one tracer at downstream and/or in the vicinity of at least one influx zone in a well The method may comprise placing, arranging, installing and/or positioning the tracer release system and/or at least one tracer release apparatus at at least one known location of a well. The tracer release system may comprise two or more tracer release apparatus. The method may comprise placing, arranging, installing and/or positioning each of the two or more tracer release apparatus at a known locations of a well. Each of the two or more tracer release apparatus may be placed, arranged, installed and/or positioned at the same or different known locations of a well. The well may be a production well or an injection well.

The method may comprise placing, arranging, installing and/or positioning the tracer release system and/or at least one tracer release apparatus downstream and/or in the vicinity of at least one influx zone in a well. Each of the two or more tracer release apparatus may be configured to be placed, arranged, installed and/or positioned downstream and/or in the vicinity of an influx zone in a well. The method may comprise measuring the presence, type and/or concentration of the at least one tracer in a production flow to allow flow measurement and/or well inflow profiles and/or characteristic of the reservoir to be calculated and/or monitored.

The method may comprise placing, arranging, installing and/or positioning the tracer release system and/or at least one tracer release apparatus upstream and/or in the vicinity of at least one injection zone in a well. Each of the two or more tracer release apparatus may be configured to be placed, arranged, installed and/or positioned upstream and/or in the vicinity of an injection zone in a well. The method may comprise pumping fluid downhole to inject and/or transport the at least one released tracer into the reservoir.

The method may comprise measuring the presence, type and/or concentration of the at least one tracer in a producer well to allow flow measurement, well inflow profiles and/or characteristic of the reservoir to be calculated and/or monitored.

Embodiments of the fifth aspect of the invention may include one or more features of any of the first to fourth aspects of the invention or their embodiments, or vice versa.

According to a sixth aspect of the invention, there is provided a method of monitoring flow in a well and/or a reservoir in fluid communication with a well comprising;

providing a tracer release system for releasing at least one tracer into a well;

the tracer release system comprising;

at least one tracer release apparatus comprising;

at least one tracer source reservoir comprising at least one tracer;

at least one injection port in fluid communication with the well;

least one controllable valve between the tracer source reservoir and the at least one injection port;

actuating the at least one controllable valve to release the at least one tracer at an even release rate at regular intervals into the well.

Embodiments of the sixth aspect of the invention may include one or more features of any of the first to fifth aspects of the invention or their embodiments, or vice versa.

According to a seventh aspect of the invention there is provided a method of monitoring flow in a production well wherein the well comprises a tracer release system comprising at least one tracer release apparatus arranged or installed at at least one known level in the well, the at least one tracer release apparatus comprising at least one tracer source reservoir comprising at least one tracer;

at least one injection port in fluid communication with the well;

at least one valve between the tracer reservoir and the at least one injection port;

releasing the at least one tracer for a preset duration and/or frequency into the well.

The method may comprise releasing the at least one tracer continuously. The method may comprise releasing the at least one tracer at an even release rate. The method may comprise adjusting the duration and/or frequency of the at least one tracer release into the well.

The method may comprise releasing the at least one tracer at a known position in the well. The tracer release system and/or at least one tracer release apparatus may be arranged or installed downstream and/or in the vicinity of at least one influx zone in a well.

The tracer release system may comprise two or more tracer release apparatus. Each of two or more tracer release apparatus may be installed or arranged at different known positions in the well. Each of two or more tracer release apparatus may be installed or arranged downstream and/or in the vicinity of at least one influx zone in a well. The method may comprise releasing at least one tracer from each of the two or more tracer release apparatus at a known positions in the well. The method may comprise arranging or installing the tracer release system and/or at least one tracer release apparatus in the well. The method may comprise arranging or installing the tracer release system and/or at least one tracer release apparatus in the well downstream stream and/or in the vicinity of at least one influx zone in a well. The method may comprise locating the two or more tracer release apparatus at known positions in the well. The method may comprise locating each of the two or more tracer release apparatus at different known positions in the well. The method may comprise arranging or installing each of the two or more tracer release apparatus downstream and/or in the vicinity of an influx zone in a well.

The at least one tracer may be detected and its concentration measured by sampling production fluid. The method may comprise sampling at one or more sampling times. The method may comprise sampling downhole downstream of the at least one tracer release apparatus and/or at surface. The sampling may be conducted downhole. Samples may be collected for later analysis.

The method may comprise measuring the presence, type and/or concentration of the at least one tracer in a production flow to allow flow measurement and/or well inflow profiles and/or characteristic of the reservoir to be calculated and/or monitored.

Embodiments of the seventh aspect of the invention may include one or more features of any of the first to sixth aspects of the invention or their embodiments, or vice versa.

According to an eighth aspect of the invention there is provided a method of monitoring flow in or from a reservoir in fluid communication with a well wherein the well comprises a tracer release system comprising at least one tracer release apparatus arranged or installed at at least one known level in the well, the at least one tracer release apparatus comprising at least one tracer source reservoir comprising at least one tracer;

at least one injection port in fluid communication with the well;

at least one valve between the tracer reservoir and the at least one injection port;

releasing the at least one tracer for a preset duration and/or frequency into the well.

The method may comprise releasing the at least one tracer continuously. The method may comprise releasing the at least one tracer at an even release rate. The method may comprise adjusting the duration and/or frequency of the at least one tracer release into the well.

The method may comprise pumping fluid downhole to inject and/or transport the released at least one tracer into the reservoir. The well may be an injector well or a producer well.

The method may comprise releasing the at least one tracer at a known position in the well. The tracer release system and/or at least one tracer release apparatus may be arranged or installed downstream and/or in the vicinity of at least one injection zone in a well.

The tracer release system may comprise two or more tracer release apparatus. Each of two or more tracer release apparatus may be installed or arranged at different known positions in the well. Each of two or more tracer release apparatus may be installed or arranged downstream and/or in the vicinity of at least one injection zone in a well. The method may comprise releasing at least one tracer from each of the two or more tracer release apparatus at a known positions in the well.

The method may comprise arranging or installing the tracer release system and/or at least one tracer release apparatus in the well. The method may comprise arranging or installing the tracer release system and/or at least one tracer release apparatus in the well downstream stream and/or in the vicinity of at least one injection zone in a well.

The method may comprise locating the two or more tracer release apparatus at known positions in the well. The method may comprise locating each of the two or more tracer release apparatus at different known positions in the well. The method may comprise arranging or installing each of the two or more tracer release apparatus downstream and/or in the vicinity of an injection zone in a well. The at least one tracer may be detected and its concentration measured by sampling well fluid in the injector well and/or producer well. The method may comprise sampling at one or more sampling times. The method may comprise sampling downhole downstream of the at least one tracer release apparatus and/or at surface. The sampling may be conducted downhole. Samples may be collected for later analysis.

The method may comprise measuring the presence, type and/or concentration of the at least one tracer in a producer well to allow flow measurement, well inflow profiles and/or characteristic of the reservoir to be calculated and/or monitored.

Embodiments of the eighth aspect of the invention may include one or more features of any of the first to seventh aspects of the invention or their embodiments, or vice versa.

According to a ninth aspect of the invention there is provided a tracer release system for releasing tracer into a well in communication with a hydrocarbon reservoir;

the tracer release system comprising;

two or more tracer release apparatus, each apparatus comprising;

at least one tracer reservoir comprising at least one tracer;

at least one injection port in fluid communication with the well;

at least one valve between the tracer reservoir and the at least one injection port;

releasing the at least one tracer for a preset duration and/or frequency into the well.

The at least one controllable valve may be configured to control an even release of the at least one tracer into the well for a desired duration and/or frequency. The at least one controllable valve may be configured to release tracer continuously into the well for an adjustably set duration and/or frequency. The tracer release system may comprise at least one control unit. The at least one control unit configured to actuate the at least one controllable valve to release tracer continuously into the well for an adjustably set duration and/or frequency.

The system may be configured to releasing tracer into an injector well and/or a producer well of an injection well.

The two or more tracer release apparatus located at known positions in the well. Each of the two or more tracer release apparatus may be configured to comprise a different tracer. The method may comprise releasing at least one tracer from each of the two or more tracer release apparatus at a known positions in the well.

Embodiments of the ninth aspect of the invention may include one or more features of any of the first to eighth aspects of the invention or their embodiments, or vice versa.

According to a tenth aspect of the invention, there is provided a method of releasing at least one tracer downhole comprising;

providing a tracer release system for releasing tracer into a well;

the tracer release system comprising;

at least one tracer release apparatus comprising;

at least one tracer reservoir comprising at least one tracer;

at least one injection port in fluid communication with the well;

at least one valve between the tracer reservoir and the at least one injection port;

actuating the at least one valve release for continuous release of tracer for a desired duration and/or frequency.

The method may comprise adjustably setting the at least one valve release for continuous release of tracer for release hourly, daily, weekly or monthly.

Embodiments of the tenth aspect of the invention may include one or more features of any of the first to ninth aspects of the invention or their embodiments, or vice versa.

According to an eleventh aspect of the invention, there is provided a method of releasing at least one tracer into a well comprising;

providing a tracer release system in a well;

the tracer release system comprising;

at least one tracer release apparatus comprising;

one or more tracer source reservoir comprising at least one tracer;

at least one injection port in fluid communication with the well;

at least one controllable valve between the tracer reservoir and the at least one injection port; and controlling the actuation of the at least one controllable valve to control the even release of tracer into the well for a desired duration and/or frequency.

The method may comprise arranging the at least one tracer release apparatus at known positions in the well. The method may comprise providing the tracer release system in a well in fluid communication with a reservoir and monitoring flow in the well and/or the reservoir by measuring the presence, type and/or concentration of the at least tracer in at least one well fluid. The method may comprise regular and/or continuous monitoring flow of fluids in the well by measuring the presence, type and/or concentration of tracer in a fluid flow. The method may comprise adjusting the duration and/or frequency of the tracer release.

The method may comprise providing the tracer release system in a production well. The method may comprise measuring the presence, type and/or concentration of tracer in production flow to allow flow measurement and/or well inflow profiles and/or characteristic of the reservoir to be calculated and/or monitored. The method may comprise providing the tracer release system in an injector well and/or a producer well. The method may comprise pumping the released tracer from the injector well into a reservoir. The method may comprise measuring the presence, type and/or concentration of tracer in a producer well to allow flow measurement, well inflow profiles and/or characteristic of the reservoir to be calculated and/or monitored.

Embodiments of the eleventh aspect of the invention may include one or more features of any of the first to tenth aspects of the invention or their embodiments, or vice versa.

BRIEF DESCRIPTION OF THE DRAWINGS

There will now be described, by way of example only, various embodiments of the invention with reference to the following drawings (like reference numerals referring to like features) in which.

DETAILED DESCRIPTION OF PREFERRED EMBODIMENTS

Figure 1:
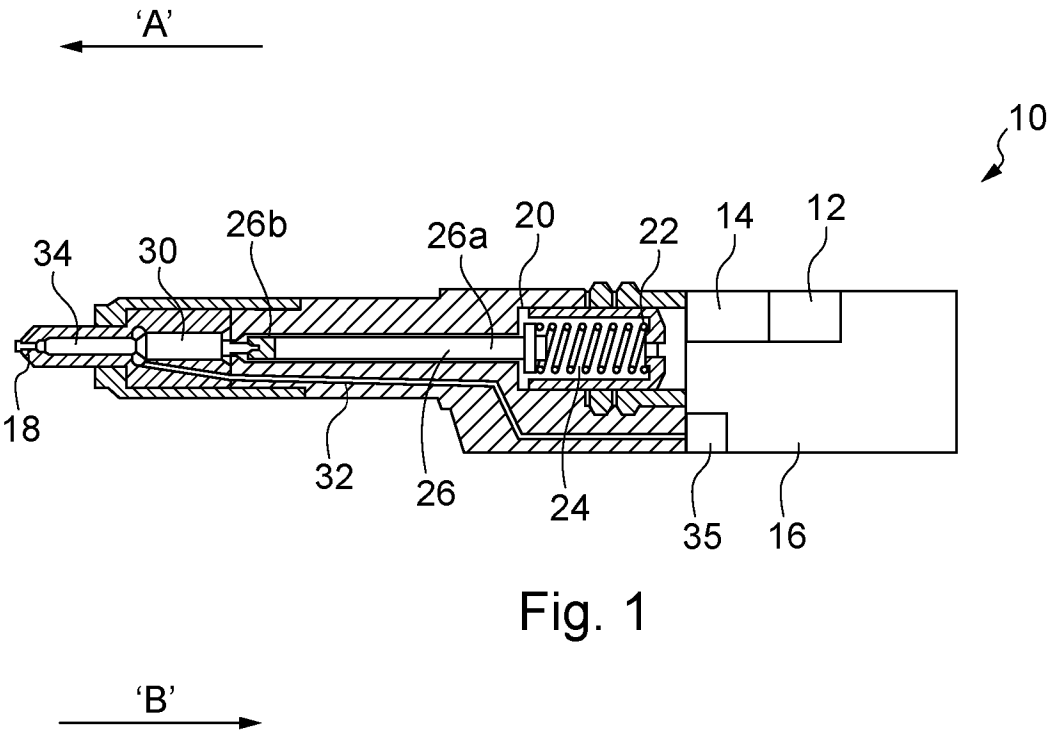
FIG. 1 shows a schematic sectional view of a tracer release apparatus according to an embodiment of the invention.

FIG. 1 shows a tracer release apparatus according to an embodiment of the invention. The tracer release apparatus 10 has a power source 12, control unit 14 and a tracer reservoir 16. The tracer reservoir comprises at least one tracer. In this example the tracer is a fluid perfluorinated hydrocarbon tracer. However, it will be appreciated that any suitable tracer may be used.

The tracer release apparatus 10 has an injection port 18 which is in fluid communication with the well, annulus and/or production pipe. The tracer release apparatus is configured to inject tracer out of the apparatus into the well, annulus and/or production pipe through the injection port 18. In this example the tracer release apparatus has only one injection port 18. However, it will be appreciated that the tracer release apparatus may have two or more injection ports.

A valve assembly 20 is located between the tracer reservoir 16 and the at least one injection port 18. The valve assembly 20 has an electrically operated solenoid actuator 22, valve spring 24 and a piston 26. The solenoid actuator 22 and valve spring 24 are attached to one end 26*a* of the piston.

A second end 26*b* of the piston is configured to move in a tracer release chamber 30 which is in fluid communication with the tracer reservoir 16 via a conduit 32. The tracer release chamber 30 which is in fluid communication with injection port 18 via conduit 34.

In operation when an injection tracer is required the control unit 14 receives a control signal. In this example the control signal is generated from a pre-programmed timer in the control unit. However, it will be appreciated that the control signal may be generated from surface or in response to a well event. The control signal sends a command signal to the actuate the solenoid actuator 22. This moves the piston to a retracted position in direction "B" as shown in FIG. 1. Retraction of the piston opens the pathway to the injection port 18 allowing tracer to flow through conduit 34 out through injection port 18 into the well.

After a pre-set period of time the control signal sends a command signal to de-actuate the solenoid actuator 22. The valve spring 24 which is a compression spring moves the piston in direction "A" as shown in FIG. 1 to an extended position. Movement of the piston to an extended position closes the pathway to the injection port 18 stopping release of tracer. The volume of tracer in the tracer release chamber may be replenished from tracer traveling to the tracer release chamber from the tracer reservoir 16 via the conduit 32. It will be appreciated that the tracer in the tracer reservoir may be pressurised to assist the travel into the tracer release chamber. A pump may be used to pressurise the tracer in the tracer reservoir or to force the tracer into the tracer release chamber from the tracer reservoir 16 via the conduit 32. It will be appreciated that the piston and/or tracer release chamber may be designed such that retraction of the piston creates a draw effect on the tracer in the conduit 32 which draws the tracer from the reservoir into the tracer release chamber. It will be appreciated that instead of a pump, an accumulator 35 such as described in FIG. 2 may be used that will maintain a pre-set pressure over the lifespan of the tool. This may allow the tracer to be released at a constant pressure and/or rate irrespective of the amount of tracer remaining in the tracer reservoir. The piston accumulator assembly is located between the tracer reservoir 16 and the tracer release chamber 30.

The duration and/or frequency of the actuation and de-actuation of the solenoid actuator 22 may be controlled by the control unit. The control unit may be configured to send command signal with a pulse width of between 0.05 seconds and 30 seconds. It will be appreciated that the duration and/or frequency described is one example and other duration and/or frequencies may be used. In other examples the duration may range anywhere from between 0.01 seconds to 10 days. The frequency may be on command or a programmed interval range of 0.1 seconds to one year.

Figure 2:
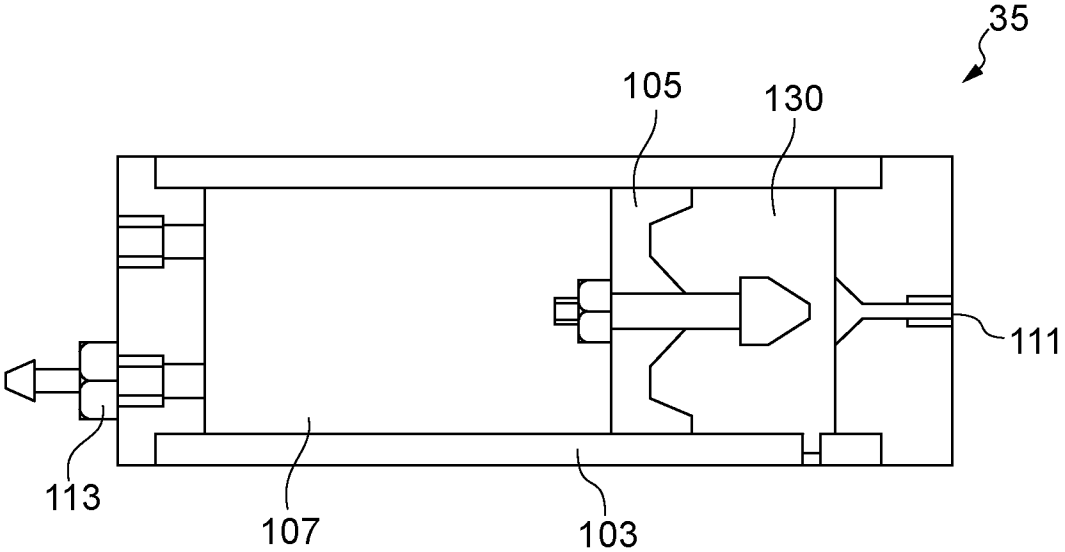
FIG. 2 shows an enlarged schematic view of a piston accumulator used in the tracer release apparatus as described in FIG. 1.

FIG. 2 shows an enlarged view of an accumulator 35 such as a piston accumulator used in the tracer release apparatus 10 as described in FIG. 1. The piston accumulator 35 has a cylinder 103 a free moving piston 105 within the cylinder. The piston 105 separates a fluid pressure chamber 107 and accumulator tracer chamber 130. The accumulator tracer chamber 130 is in fluid communication with tracer chamber 30 via outlet 111 and conduit 32 (best shown in FIG. 1). The pressure of the fluid in the fluid pressure chamber 107 may be adjusted and/or set by adding or removing fluid to the fluid pressure chamber by the charging valve 113. The accumulator 35 is configured to maintain a positive pressure acting on the tracer to enable an even release rate of tracer during a period of time the tracer apparatus in in a tracer release condition.

In one example the injection port 18 is in fluid communication with the well. The tracer apparatus is configured to inject tracer out into the well through the injection port 18. In this example the tracer release apparatus has only one injection port. However, it will be appreciated that the apparatus may have two or more injection ports.

In this example the fluid in the fluid pressure chamber 107 is nitrogen gas. The fluid pressure in the chamber 107 may be maintained at a preset level to control the pressure applied to the piston and therefore the tracer in the tracer chamber. This may allow the tracer to be injected into the well at an even release rate for a sustained period of time. This period of time may be until a control unit deactivates the piston or the reservoir is depleted of tracer. The pressure of the fluid pressure chamber 107 may be set for the lifetime of the apparatus or the pressure of the fluid pressure chamber 107 may be adjusted and set to different pressures on command from surface or the control unit.

When the valve assembly 20 is in a closed condition it prevents injection of tracer through the injection port 18. The control unit controls the operation of the valve assembly 20 to an open condition (tracer release condition).

The duration and/or frequency of the actuation and de-actuation of the valve assembly may be controlled by the control unit. The control unit may be configured to send command signal with a pulse width of between 0.05 seconds and 10 minutes. It will be appreciated that the duration and/or frequency described is one example and other duration and/or frequencies may be used.

Figure 3:
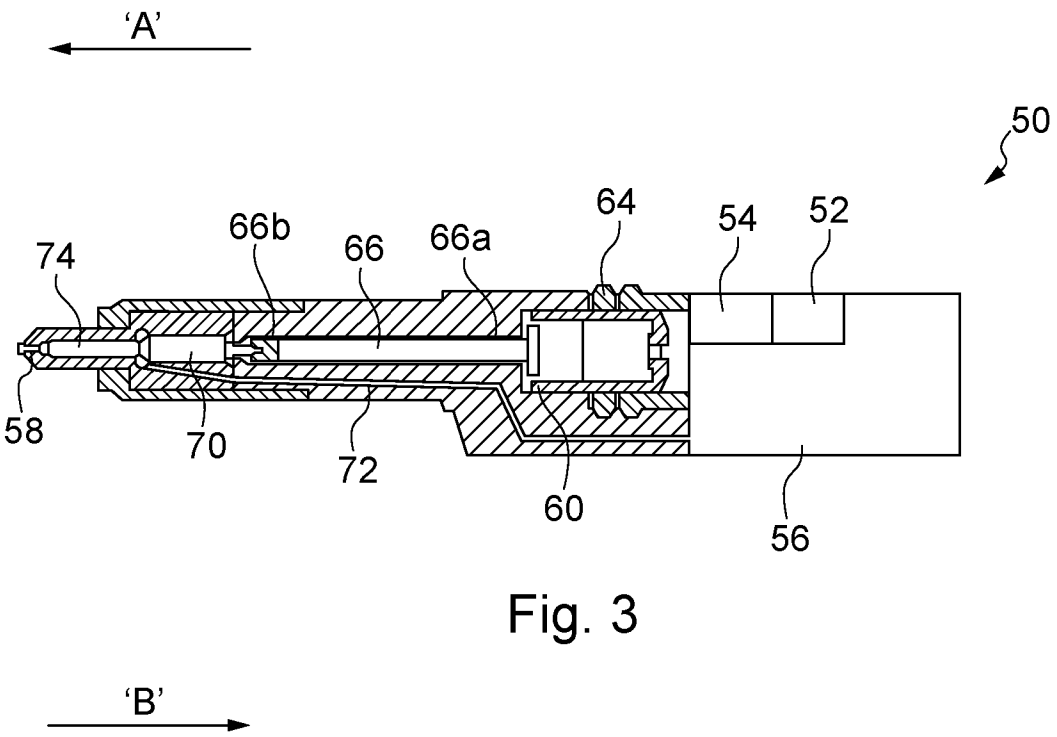
FIG. 3 shows a schematic sectional view of a tracer release apparatus which comprises a nitrogen spring according to an embodiment of the invention.

FIG. 3 show an alternative arrangement of a tracer release apparatus 50. The tracer release apparatus 50 and its method of operation is similar to the tracer release apparatus 10 described in FIG. 1 above. However, the valve assembly 60 comprises a nitrogen spring 64 instead of the mechanical valve spring 24 to return the piston to its retracted position. The nitrogen spring operates through the use of nitrogen gas contained within a cylinder. When the gas is compressed, a spring force is produced to control the operation of the valve.

Figure 4:
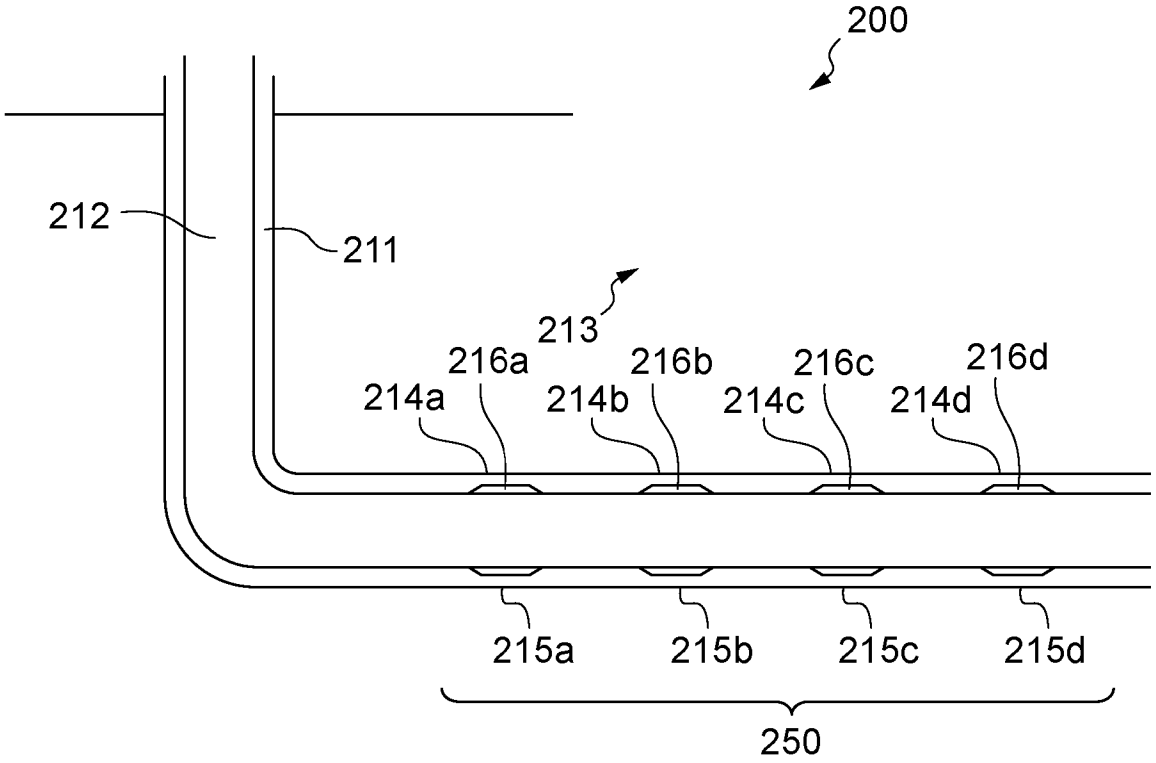
FIG. 4 shows a schematic sectional view of a production well with tracer release system comprising four tracer release apparatus as described in FIG. 1.

FIG. 4 is a simplified section through a production well 200. A central production tubing 212 is arranged in the well surrounded by annulus 211. Influx volumes of fluids enter the well from a reservoir 213 into the central production tubing 212 via separate influx locations. In this example the tracer release system 250 is installed on or in a production tubing. It will be appreciated that the tracer release system may be installed or arranged as part of the completion. Alternatively, the tracer release system may be lowered into the well via coiled tubing, wireline, slickline, drill pipe or a similar conveyance.

In this example, there are four influx locations 215*a*, 215*b*, 215*c* and 215*d* and four tracer release apparatus 216*a*, 216*b*, 216*c* and 216*d* each with a tracer source with different tracer material distinct for each influx location. A tracer release apparatus is arranged near each influx location. Tracers are released by each of the four apparatus and measurements taken downstream of the tracer release apparatus and/or at surface to provide information on which influx locations are producing and the rates of influx. The measurements may be taken by sampling well fluids or by real time measurements. However, there may be a different number of influx zones and/or tracer release apparatus than illustrated in FIG. 1. An adjustable choke assembly may be arranged to control the production flow rate. Arrows in the examples below denote the direction of fluid travel. Each tracer release apparatus may have a signal transmitter for transmitting a signal to the other tracer release apparatus in the system or to a central control unit 214 used to control the command signals sent to each tracer release apparatus in the system.

In this example each of the tracer release apparatus 216*a*, 216*b*, 216*c* and 216*d* has a separate control unit 214*a*, 214*b*, 214*c* and 214*d* which is configured to control the actuation of each of the four tracer release apparatus. However, it will be appreciated that alternatively or additionally the system 250 may comprise a central control unit 214 configured to control each of the four tracer release apparatus. Alternatively one or more of the tracer release apparatus may be controlled directly from surface wirelessly or by wired connection.

The system 250 is programmed for synchronised release of tracer from all four tracer release apparatus 216*a*, 216*b*, 216*c* and 216*d* along the well. The control unit of each tracer release apparatus 216*a*, 216*b*, 216*c* and 216*d* receives a command signal to synchronise the actuation of the respective valves to release tracer.

Each control unit 214*a*, 214*b*, 214*c* and 214*d* is programmed to release tracer for a desired duration for example five minutes and at a desired frequency for example release tracer once a day. This may allow regular or continuous monitoring of flow of fluids in the well and production logging. It will be appreciated that a wide range of durations and/or frequencies may be selected depending on a number of factors including tracer injection application, well conditions, tracer type, tracer amount, battery lifespan and requirements of the user. It will also be appreciated the duration and/or frequency of the tracer release may be set and/or adjusted when the system is located downhole.

Additionally, or alternatively the system 250 may be programmed for consecutive release of tracer from four tracer release apparatus 216*a*, 216*b*, 216*c* and 216*d* along the well. A control unit of a first tracer release apparatus 216*a* actuates the valve to release tracer and transmits a control signal to a second tracer release apparatus 216*b* which releases tracer and in turn transmits control signal to a third tracer release apparatus 216*c* which releases tracer. In this way the control mechanism of the next release apparatus is activated only after previous release apparatus resulting in a sequential release.

Additionally, or alternatively the system 250 may be programmed for release of tracer from four tracer release apparatus 216*a*, 216*b*, 216*c* and 216*d* in a fixed pre-set pattern along the well.

In the above example the command signal is generated from a pre-set programme in a control unit of the system as an example the tracer release system release is controlled by a downhole pre-set timer device. However, it will be appreciated that the command signal may alternatively or additional be generated from surface either wirelessly or by wire or in response to a well event.

In the above example a liquid form of tracer is used. The release of tracers can be done by opening a valve to open a pathway to the tracer chamber and/or having a piston which squeezes or forces tracer into the well. The use of a nitrogen spring may allow the tracer to be ejected at minimum energy usage thereby enabling repeated release at desired frequency, preserving the battery power and extending the downhole battery lifespan. It will be appreciated that tracer in the form of gas, powder or gel may additionally or alternatively be used.

Providing a tracer release system which can control and adjust the duration and frequency of tracer release of each tracer release apparatus may mitigate drift between the simultaneous release of tracers located considerable distances apart. This may allow accurate measurements of the arrival of tracer at detection point downstream of the release locations.

Figure 5A:
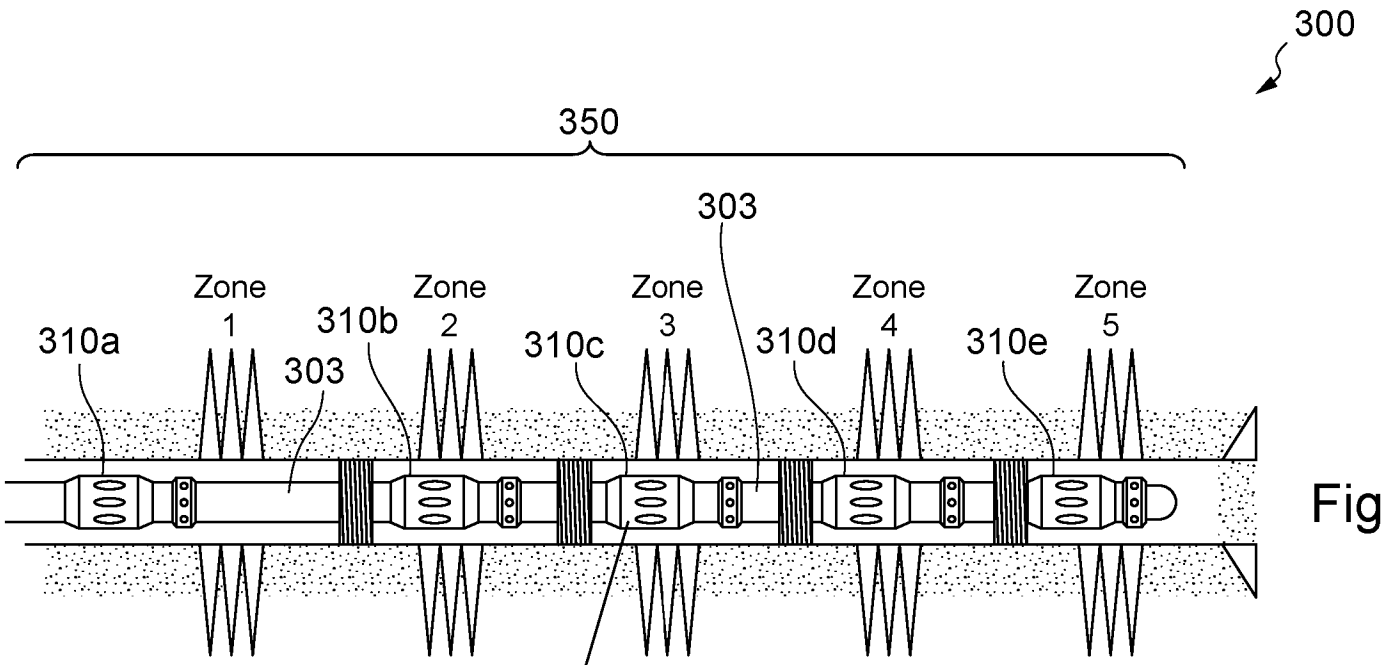
FIG. 5A shows a schematic view of a tracer release apparatus used in a production well application according to an embodiment of the invention.
Figure 5B:
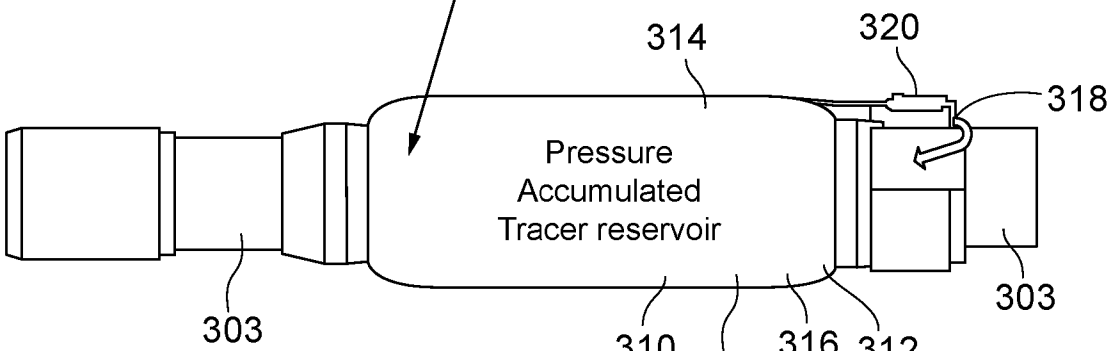
FIG. 5B shows an enlarged view of one tracer release apparatus of the tracer release system of FIG. 5A.

FIG. 5A shows a schematic view of a well with five tracer release apparatus 310 (310*a*, 310*b*, 310*c*, 310*d*, 310*e*) mounted on a tubular 303. The tracer release apparatus 310 is used in a well production application according to an embodiment of the invention. FIG. 5B shows an enlarged view of one of the tracer release apparatus of FIG. 5A.

The tracer release apparatus 310 has a power source 312, control unit 314 and a tracer reservoir 316. The tracer reservoir comprises at least one tracer. The tracer apparatus 310 has an injection port 318 in fluid communication with the well. The tracer is configured to be injected out of the apparatus into the tubular 303 through the injection port 318. An accumulator assembly 325 is located between the tracer reservoir 316 and the at least one injection port 318. The piston accumulator 325 has a piston within the cylinder. The piston separates a fluid pressure chamber and a tracer chamber which is in fluid communication with the tracer reservoir 316. The accumulator 325 is in fluid communication with the valve assembly 320 via conduit 332.

Figure 5C:
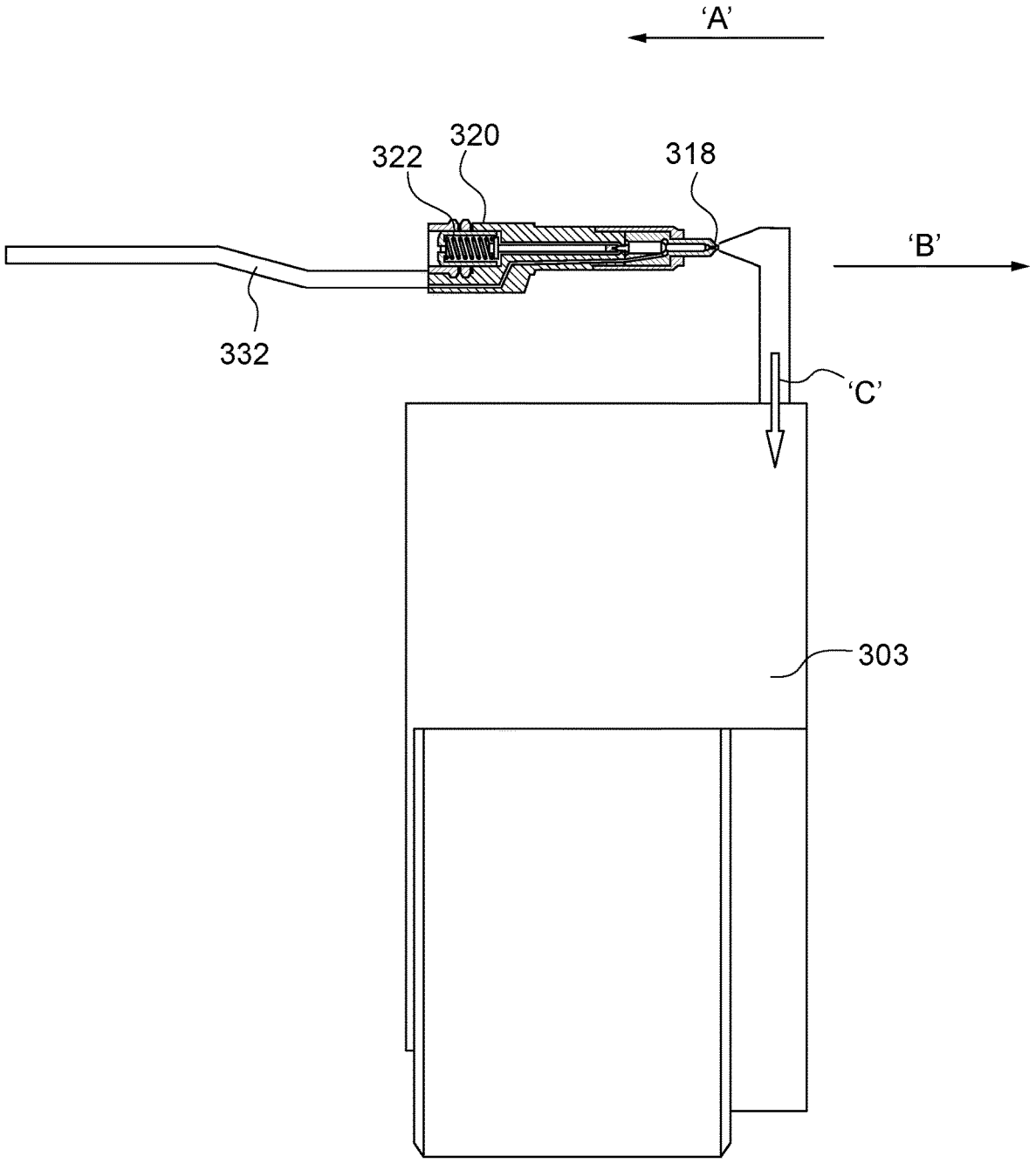
FIG. 5C shows an enlarged sectional view of the tracer release apparatus of FIG. 5B.

In operation when a tracer injection is required the control unit receives a release control signal. In this example the release control signal is generated from a pre-programmed timer in the control unit. However, it will be appreciated that the control signal may be generated in response to a well event or from surface via a wireless or wired connection. The release control signal sends a command signal to the actuate the valve assembly 320. In this example the control signal actuates the solenoid actuator 322. This moves the piston to a retracted position in direction "A" as shown in FIG. 5C. Retraction of the piston moves the valve assembly 320 to an open condition. The tracer is pressurised by the accumulator 325 and is forced through conduit 334 out through injection port 318 into the tubular shown as arrow 'C' in FIG. 5C. The accumulator may be adjustably controlled to exert a known pressure on the tracer such that it is released through the injection port at continuous or even release rate.

After a pre-set period of time the control signal sends a command signal to de-actuate the piston 326. A valve spring which is a compression spring moves the piston in direction "B" as shown in FIG. 5C to a closed valve assembly condition.

The duration and/or frequency of the actuation and de-actuation of the piston is controlled by the control unit. The control unit may be configured to send command signal with a pulse width of between 0.05 seconds and 10 minutes. It will be appreciated that the duration and/or frequency described is one example and other duration and/or frequencies may be used.

Figure 6:
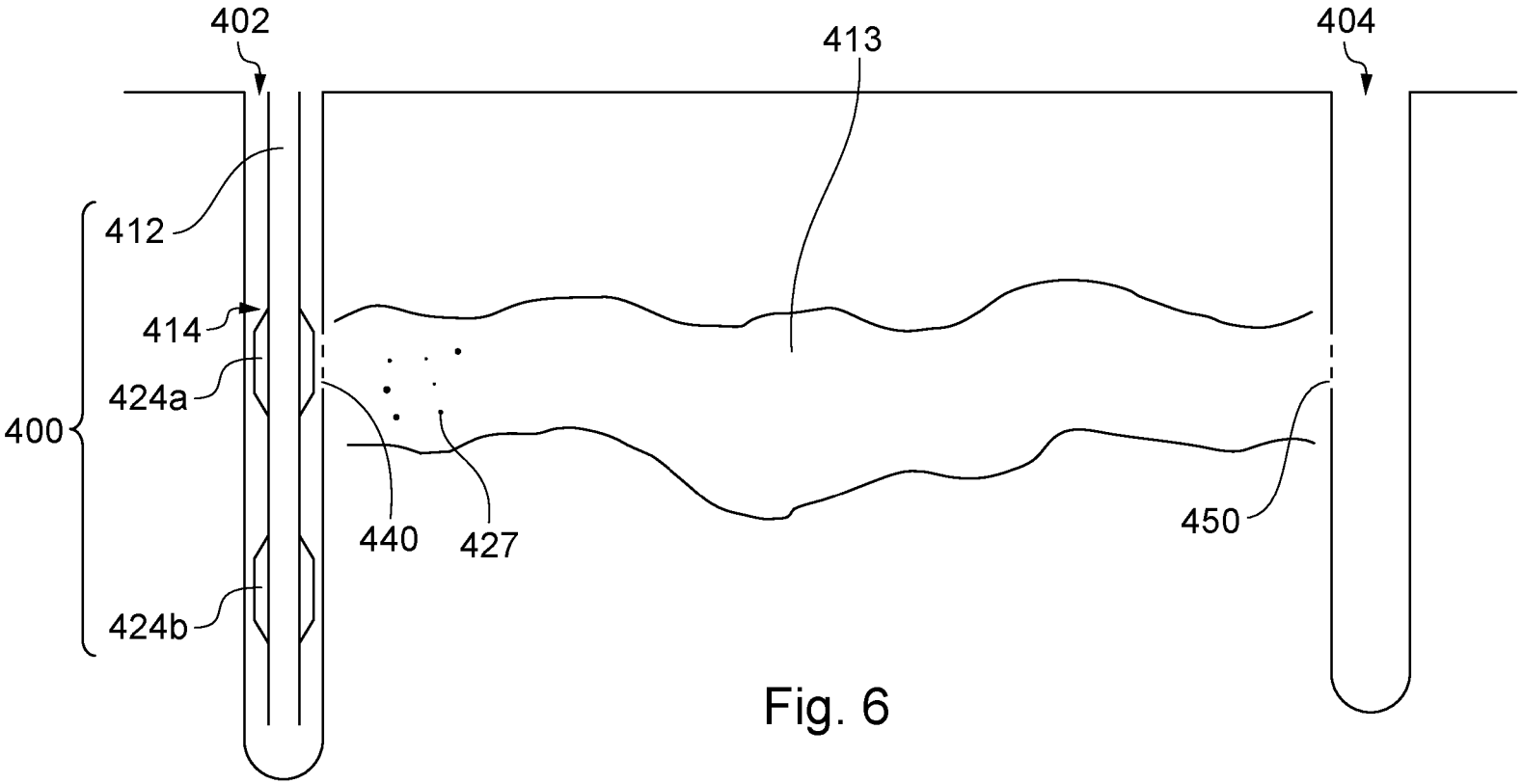
FIG. 6 shows a schematic sectional view of an injection well with a tracer release system comprising two tracer release apparatus as described in FIG. 1.

FIG. 6 shows a simplified section through an injector well 402 and a producer well 404 in communication with a reservoir 413 with tracer release system 400 for releasing tracer into the injector well 402. In this example the system 400 comprises two tracer release apparatus 424 each as described in FIG. 1. Although the system uses tracer release apparatus as described in FIG. 1, it will be appreciated that the system may alternatively or additionally use tracer release apparatus as described in FIG. 3.

As shown in FIG. 6 two tracer release apparatus 424*a* and 424*b* are installed in or on the central tubing 412 at known levels in the well. The two tracer release apparatus are arranged, installed, or positioned at a known levels in the well.

The system 400 has a central control unit 414 which is configured to control the actuation of each of the two tracer release apparatus. However, it will be appreciated that alternatively or additionally each of the two tracer release apparatus may comprise a control unit. Alternatively each of the two release apparatus may be controlled from surface via a wireless or wired connection.

In use, to inject tracer into the reservoir 413 the control unit 414 receives a release command signal for tracer release apparatus 424*a*. The signal may originate from surface or a programme set in the control unit 414. The control unit 414 sends a command signal to actuate tracer release apparatus 424*a*.

In order to ensure that tracer may be detected downstream of the reservoir it is important to ensure that a sufficient quantity of tracer is injected into the reservoir. The control unit actuates the tracer release apparatus 424*a* for a pre-set duration in the form of a tracer release pulse. In this example the tracer release apparatus pulse releases tracer into the injection well for a duration of 5 hours. After 5 hours the control unit 414 controls the de-actuation of the tracer release apparatus 424*a* and release of tracer from the tracer release apparatus 424*a* stops.

After tracer 427 is released into the injector well 402. Fluid such as water is pumped into the injection well 402 to push the released tracer 427 from the injection well 402 into the reservoir 413 through injection zone 440.

The released tracer may be carried with production flow from the reservoir into one or more producer wells downstream of the reservoir. In this example producer well 404 is monitored for the presence, type and/or concentration of tracer in the production fluid from the reservoir though one or more influx zones 450.

The tracer injection operation from tracer release apparatus 424*a* may be repeated by sending a further signal from the control unit 414 to actuate the tracer release apparatus 424*a*. The source of the further signal may be a command signal from surface. Additionally, or alternatively the source of the signal may be a programmed signal designed to send signals at a pre-set frequency, for example once every 24 hours.

The duration and/or frequency of the tracer release pulse may be adjusted by the control unit receiving adjustment instructions from surface.

Additionally, or alternatively the control unit 414 may actuate tracer release apparatus 424*b* to release a second tracer. The control unit 414 may be actuate the release tracer from tracer release apparatus 424*b* instead of tracer release apparatus 424*a*. The control unit 414 may be configured to actuate both tracer release apparatus 424*a*, 424*b*. The control unit 414 may be configured to actuate both tracer release apparatus 424*a*, 424*b* for synchronised, alternating and/or staggered release.

In the above example the control unit 414 is described as receiving an actuation signal from surface or a programme set in the control unit 414. Additional or alternatively the control unit may receive a signal based on a parameter or condition in the well. The control unit may receive a command signal from one or more sensors. As an example, the amount of water injected into the formation at a zone may be monitored and when a threshold amount is released a control signal is sent to the control unit to immediately actuate or de-actuate the tracer release. Alternatively, or additional the control signal may start the tracer release timing programme, to control the release duration and/or frequency.

Figure 7A:
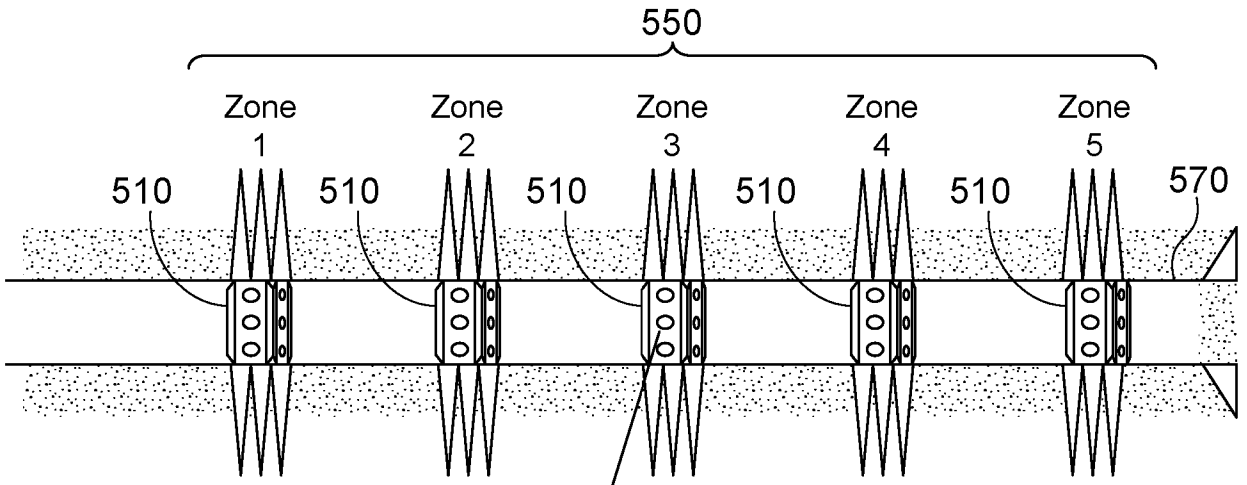
FIG. 7A shows a schematic view of a tracer release system used in a well injection application according to an embodiment of the invention.
Figure 7B:
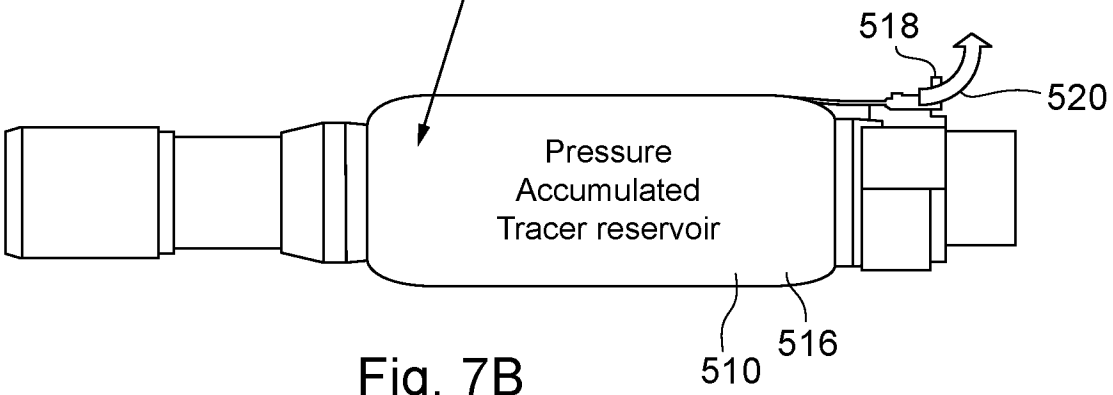
FIG. 7B shows an enlarged view of the one tracer release apparatus of the tracer release system of FIG. 7A.
Figure 7C:
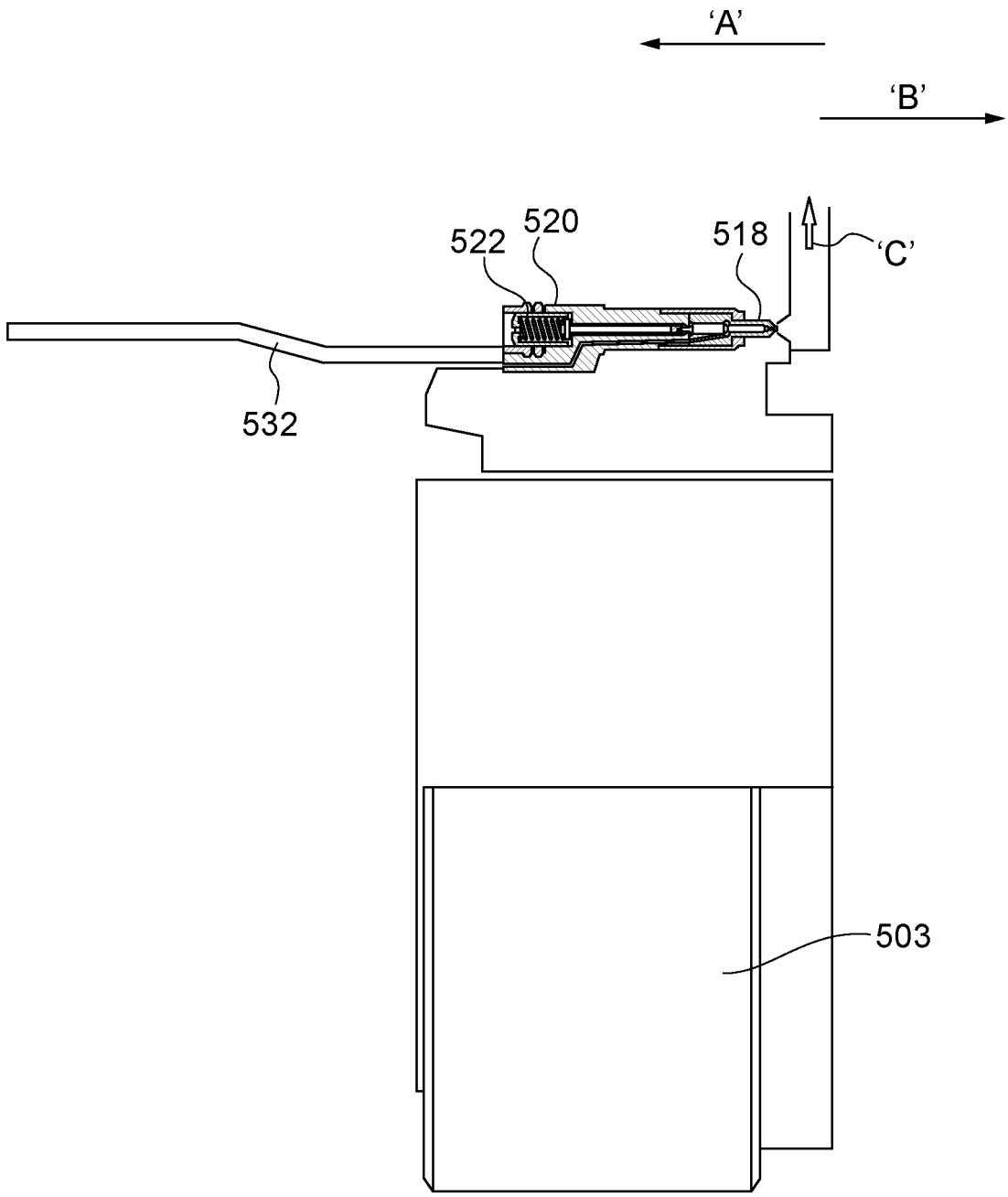
FIG. 7C shows an enlarged sectional view of the tracer release apparatus of FIG. 7B.

FIG. 7A shows a schematic view of a tracer release system 550 used in a well injection application according to an embodiment of the invention. FIG. 7B shows an enlarged view of one of the tracer release apparatus of the system 550 shown in FIG. 7A. The tracer release system 550 and its method of operation is similar to the tracer release system 350 and will be understood from the description of FIG. 5A above. However, the injector port (outlet) 518 is in fluid communication with the well annulus 570 and is configured to inject tracer into the well annulus. The control unit sends a control signal to the actuate the valve assembly 520. In this example the control signal actuates the solenoid actuator 522. This moves the piston to a retracted position in direction "A" as shown in FIG. 7C. Retraction of the piston moves the valve assembly 520 to an open condition. The tracer is pressurised by the accumulator 525 and is forced through injection port 518 into the well annulus shown as arrow 'C' in FIG. 7C. The accumulator is adjustably set to exert a known pressure on the tracer such that it is released through the injection port at continuous or even release rate.

The duration and/or frequency of the actuation and de-actuation of the valve assembly 520 is controlled by the control unit. The control unit may be configured to send command signal with a pulse duration of between 1 hour and 10 days. It will be appreciated that the duration and/or frequency described is one example and other duration and/or frequencies may be used. After a pre-set period of time the control signal sends a signal to de-actuate and move the piston in direction "B" as shown in FIG. 7C to a closed valve assembly condition. It will be appreciated that the tracer reservoir may be dimensioned to hold or store tracer in sufficient quantities to allow continuously release of tracer over periods of days, weeks or even months.

Figure 8:
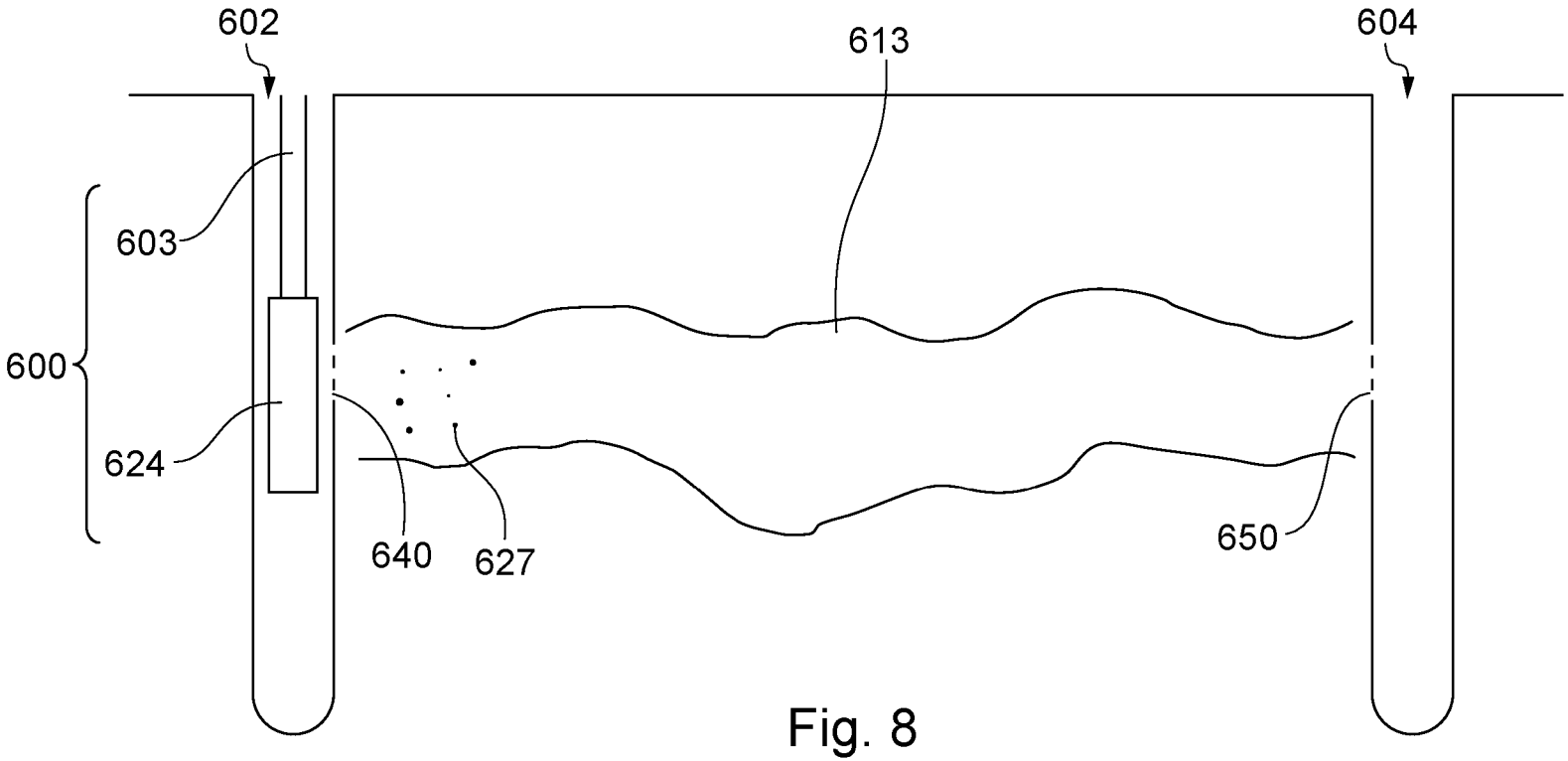
FIG. 8 shows a schematic sectional view of an injection well with tracer release system comprising a tracer release apparatus as described in FIG. 1.

FIG. 8 shows a schematic sectional view of an injector well 602 and a producer well 604 in communication with a reservoir 613. The tracer release system 600 is similar to the system 400 described in FIG. 6 and will be understood from the description of FIG. 6. However, the tracer release system 600 in not installed as part of the completion, in or on a central tubing. Instead in this example the tracer release system 600 is attached or installed coiled tubing. In the example shown in FIG. 8 one tracer release apparatus 424 is shown attached to a coiled tubing 603. It will be appreciated that alternative means of lowering and raising the tracer release system 600 in the injection well 610 may include wireline, slickline, drill pipe or a similar conveyance.

The tracer release apparatus 600 is lowered into the injector well to a known level in the well. The known level is in the vicinity or locality of one or more injection zones. In this example there is one injection zone 640. The subsequent tracer release and characterising of the reservoir, injector well and/or producer well are the same as and will be understood from FIG. 6.

In the above example the tracer release apparatus 624 position in the well is known to arrange, locate and/or position the tracer release apparatus and the release tracer in the vicinity or locality of the injection zone 640.

It will be appreciated that the multiple tracer release apparatus may be located in the vicinity or locality of the same injector zone. Alternatively, the well may have multiple injector zones and multiple tracer release apparatus may be located in the well with each tracer release apparatus positioned in the vicinity or locality of a specific injection zone.

The invention may provide a tracer release system and method of use for releasing tracer into a well. The tracer release system comprises at least one tracer release apparatus comprising one or more tracer reservoir comprising at least one tracer. The at least one tracer release apparatus comprises at least one injection port in fluid communication with the well. The apparatus also comprises at least one controllable valve configured to control an even release of the at least one tracer into the well for a desired duration and/or frequency.

The invention may provide a method and system for monitoring downhole zonal contributions of well fluid to production flow in a petroleum production well. The tracer release system may be configured to selectively control the frequency and duration of tracer release into the well to allow accurate production flow measurement and wellbore inflow profiles to be calculated and monitored.

A benefit of controlling the frequency and duration of the tracer release enable the tracer release system to control the volume and/or rate of high concentration of tracer released thereby extending the lifespan of the tracer downhole. It may also preserve the power and tracer supply downhole. Embodiments of the invention may allow quantification of influx flow within a given duration or period of time without requiring the well to be shut in. The quantification of influx flow from one or more zones in a well may be repeatable.

A benefit of controlling the frequency and duration of the tracer release is that the apparatus can be controlled to evacuating a large amount of tracer for example for introducing a large quantity of tracer into a reservoir. Alternatively, the apparatus can be controlled to release a small quantity for long-term production well flow analysis.

Embodiments of the invention may allow multiple local high concentration tracer injections into the well in the form of tracer clouds within a given duration. The tracer injections may be repeatable and consistent. The amount of tracer release may also be adjusted such that sufficient quantity or concentration may be detectable in the well fluid using a real time probe.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as "up", "down", "top", "bottom", "upper", "lower", "upward", "downward", "horizontal", "vertical", "extend", "retract" and the like are used herein to indicate directions and locations as they apply to the appended drawings and will not be construed as limiting the invention and features thereof to particular arrangements or orientations.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention as defined by the appended claims.

The invention claimed is:

1. A tracer release system for releasing tracer into a well, comprising:

at least one tracer release apparatus comprising:

at least one tracer source reservoir comprising at least one tracer;

at least one accumulator;

at least one injection port configured to be in fluid communication with the well; and at least one controllable valve between the at least one tracer source reservoir and the at least one injection port;

wherein the at least one accumulator is configured to maintain a positive pressure acting on the tracer to adjustably control an even release rate of tracer during a period of time the tracer release system is in a tracer release condition, and wherein the at least one controllable valve is configured to adjustably set a volume, duration and/or frequency of the tracer release into the well.

2. The tracer release system according to claim 1 wherein the at least one controllable valve is configured to continuously release tracer at an even release rate while the at least one controllable valve is in an open and/or release condition.

3. The tracer release system according to claim 1 further comprising at least one control unit configured to control the actuation of the at least one controllable valve to control and/or adjust a desired volume, duration and/or frequency of tracer release into the well.

4. The tracer release system according to claim 1 wherein the at least one controllable valve is configured to actuate in response to a pre-set programme, timer, a trigger event and/or to a command signal from surface.

5. The tracer release system according to claim 1 wherein the at least one controllable valve is configured to release tracer from the at least one tracer release apparatus in the form of a pulse.

6. The tracer release system according to claim 1 wherein the at least one tracer is a liquid, solid or gas.

7. The tracer release system according to claim 1 wherein the at least one tracer release apparatus is configured to release a continuous high-concentration of tracer configured to be detected at a position downstream of the tracer release apparatus and/or at surface.

8. The tracer release system according to claim 1 wherein the well is an injection well or a production well.

9. The tracer release system according to claim 1 wherein the tracer release system is configured to be arranged in an injection well, wherein the desired duration is in the range of 2 hours to 3 days and/or the desired frequency is in the range of 1 month to 1 year.

10. The tracer release system according to claim 1 wherein the tracer release system is configured to be arranged in a production well, wherein the desired duration of tracer release is in the range of 0.1 seconds and 10 minutes, and the desired frequency of tracer release is in the range of 12 hours to 10 days.

11. The tracer release system according to claim 1 wherein the at least one tracer is a chemical tracer selected from the group consisting of perfluorinated hydrocarbons and perfluoroethers.

12. A tracer release apparatus comprising:

at least one tracer source reservoir comprising at least one tracer;

at least one accumulator;

at least one injection port in fluid communication with a well; and at least one controllable valve between the at least one tracer source reservoir and the at least one injection port;

wherein the at least one accumulator is configured to maintain a positive pressure acting on the tracer to adjustably control an even release rate of tracer during a period of time the tracer apparatus is in a tracer release condition and wherein the at least one controllable valve is configured to adjustably set a volume, duration and/or frequency of the tracer release into the well.

13. The tracer release apparatus of claim 12 further comprising a control unit configured to control the actuation of the at least one controllable valve to control and/or adjust a desired volume duration and/or frequency of the tracer release into the well.

14. A method of releasing at least one tracer into a well comprising:

providing a tracer release system in a well, the tracer release system comprising at least one tracer release apparatus comprising:

one or more tracer source reservoir comprising at least one tracer;

at least one accumulator;

at least one injection port in fluid communication with the well;

at least one controllable valve between the one or more tracer source reservoir and the at least one injection port; and controlling the actuation of the at least one accumulator and the at least one controllable valve to control the even release of tracer into the well and to adjustably set a volume, duration and/or frequency of the tracer release into the well.

15. The method according to claim 14 further comprising arranging the at least one tracer release apparatus at known positions in the well.

16. The method according to claim 14 further comprising:

providing the tracer release system in a well in fluid communication with a reservoir; and monitoring flow in the well and/or the reservoir by measuring the presence, type and/or concentration of the at least tracer in at least one well fluid.

17. The method according to claim 14, further comprising regularly and/or continuously monitoring flow of fluids in the well by measuring the presence, type and/or concentration of tracer in a fluid flow.

18. The method according to claim 14 comprising adjusting the duration and/or frequency of the tracer release.

19. The method according to claim 14 further comprising providing the tracer release system in a production well.

20. The method according to claim 19 further comprising measuring the presence, type and/or concentration of tracer in production flow to allow flow measurement and/or well inflow profiles and/or characteristic of the reservoir to be calculated and/or monitored.

21. The method according to claim 14 further comprising providing the tracer release system in an injector well and/or a producer well.

22. The method according to claim 21 comprising pumping or injecting the released tracer from the injector well into a reservoir.

23. The method according to claim 21 further comprising measuring the presence, type and/or concentration of tracer in a producer well to allow flow measurement, well inflow profiles and/or characteristics of the reservoir to be calculated and/or monitored.

* * * * *